US008033872B2

(12) United States Patent
Yang et al.

(10) Patent No.: US 8,033,872 B2
(45) Date of Patent: Oct. 11, 2011

(54) CONTACT TERMINAL FOR TEST SOCKET

(75) Inventors: Chih-Kai Yang, Tu-cheng (TW); Hsiu-Yuan Hsu, Tu-cheng (TW); Ke-Hao Chen, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/005,498

(22) Filed: Jan. 12, 2011

(65) Prior Publication Data

US 2011/0171839 A1 Jul. 14, 2011

(30) Foreign Application Priority Data

Jan. 12, 2010 (TW) ..... 099200596

(51) Int. Cl.
*H01R 13/24* (2006.01)

(52) U.S. Cl. ..... 439/700; 439/66

(58) Field of Classification Search ..... 439/700, 439/66, 482, 824
See application file for complete search history.

(56) References Cited

U.S. PATENT DOCUMENTS

| | | | | |
|---|---|---|---|---|
| 7,025,602 | B1 | 4/2006 | Hwang | |
| 7,256,593 | B2 | 8/2007 | Treibergs | |
| 7,467,952 | B2 * | 12/2008 | Hsiao et al. | 439/66 |
| 7,878,867 | B2 * | 2/2011 | Lin | 439/700 |
| 2009/0253313 | A1 * | 10/2009 | Hsiao et al. | 439/786 |
| 2010/0035472 | A1 * | 2/2010 | Hsiao et al. | 439/626 |
| 2010/0068947 | A1 * | 3/2010 | Hsiao et al. | 439/786 |

* cited by examiner

*Primary Examiner* — Hien Vu
(74) *Attorney, Agent, or Firm* — Andrew C. Cheng; Wei Te Chung; Ming Chieh Chang

(57) ABSTRACT

An electrical connector contact comprises an upper and lower contact pins and a spring device disposed between the upper and lower contact pins. The upper contact pin includes a main portion, two pair of stopping portions respectively projecting from two sides of the main portion, and two guiding slots each formed between two stopping portions located at a same side of the main portion. The lower contact pin has a pair of elastic arms directly made from lacerating and bending a metallic plate and received in the guiding slots, a pair of clamping portions clamping the main portion, and two hooks abutting against the stopping portions to prevent the upper and lower contact pins separating from each other.

13 Claims, 5 Drawing Sheets

CONTACT TERMINAL FOR TEST SOCKET

BACKGROUND OF THE INVENTION

1. Field of the Invention

The present invention relates to a contact terminal, and more particularly to a contact terminal for test socket in which the contact terminal is configured with upper and lower contact pins biased from each other with a coil spring arranged therebetween. The lower contact pin is featured with a pair of offset arms slidably moves along opposite surfaces of the upper contact pin.

2. Description of Related Art

A contact terminal for test socket disclosed in U.S. Pat. No. 7,025,602 issued to Hwang on Apr. 11, 2006 includes an upper and a lower contact pins having same structure and electrically connecting with each other, and a spring arranged between the upper and the lower contact pins and providing a repellent force for two contact pins to move away from each other along a vertical direction. The upper and lower contact pins both comprise a base portion, a pair of elastic arms extending downwardly from bottom sides of the base portion, two hooks with inclined guiding surfaces and respectively disposed at a free end of each elastic arm, and two openings defined on two opposite sides of the base portion. The upper and the lower contact pins are assembled together through the hooks of the upper contact pin matching with the openings of the lower contact pin and the hooks of the lower contact pin matching with the openings of the upper contact pin.

The contact terminal described above has following disadvantages. Firstly, the upper and the lower contact pins each has a complex structure, and are not easy to be manufactured. Secondly, the contact terminal has an unstable contacting between the upper and the lower contact pins because contacting surfaces between the upper and the lower contact pins are the inclined guiding surfaces of the hooks which are rough and the surfaces of the openings which are rough, so as to effect electrical connection of an electrical connector.

Hence, it is desirable to provide an improved contact terminal to overcome the aforementioned disadvantages.

SUMMARY OF THE INVENTION

Accordingly, an object of the present invention is to provide a contact terminal having reliable contacting between upper and lower contact pins thereof.

According to one aspect of the present invention, a contact terminal comprises an upper and a lower contact pins and a spring device disposed between the upper and lower contact pins. The lower contact pin configured from a sheet metal includes a main body with a pair of elastic arms extending upwardly and offset from a central plane of the main body so as to define a receiving space therebetween. The upper contact pin is configured to electrically couple with the lower contact pin and electrically received within the receiving space defined between the elastic arms contacting with the upper contact pin.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

FIGS. 1-5 illustrate a contact terminal 1 in accordance to a preferred embodiment of the present invention, which is generally assembled in a test socket for connecting an IC (not shown) to a PCB (not shown). The contact terminal 1 includes an upper and a lower contact pins 2, 3 and a spring device 4 located between the upper and lower contact pins 2, 3 to provide a repellent force for the upper and lower contact pins 2, 3 to move away from each other.

Figure 1:
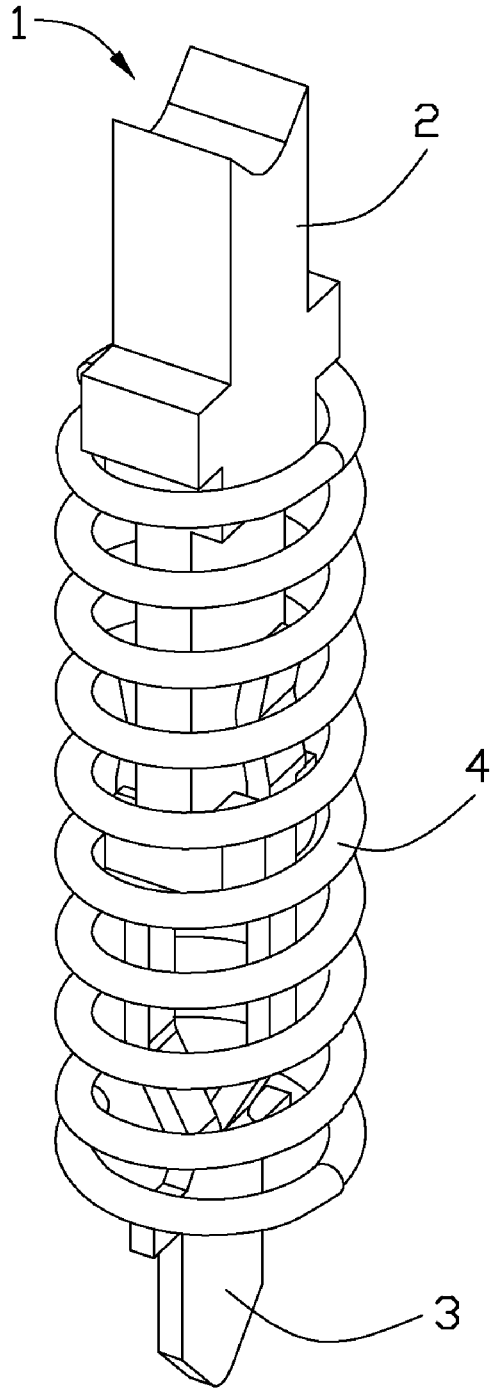
FIG. 1 is a perspective view of a contact terminal in accordance with a preferred embodiment of the present invention.
Figure 2:
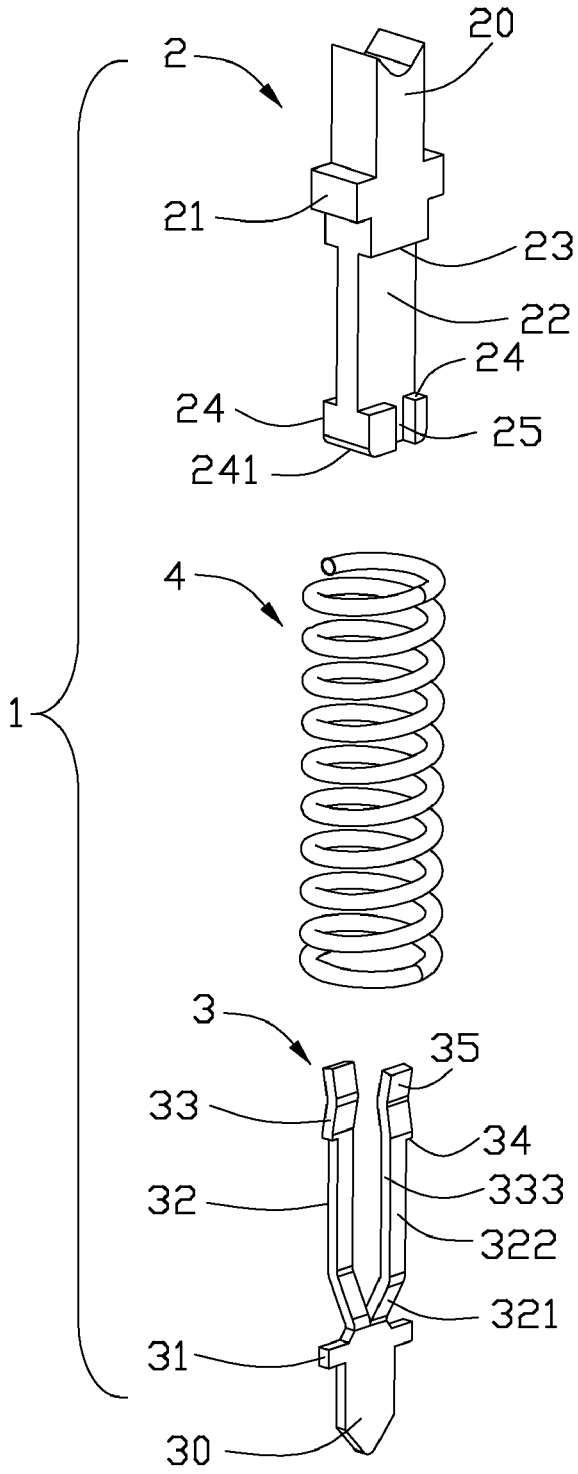
FIG. 2 is an exploded, perspective view of the contact terminal shown in FIG. 1.
Figure 3:
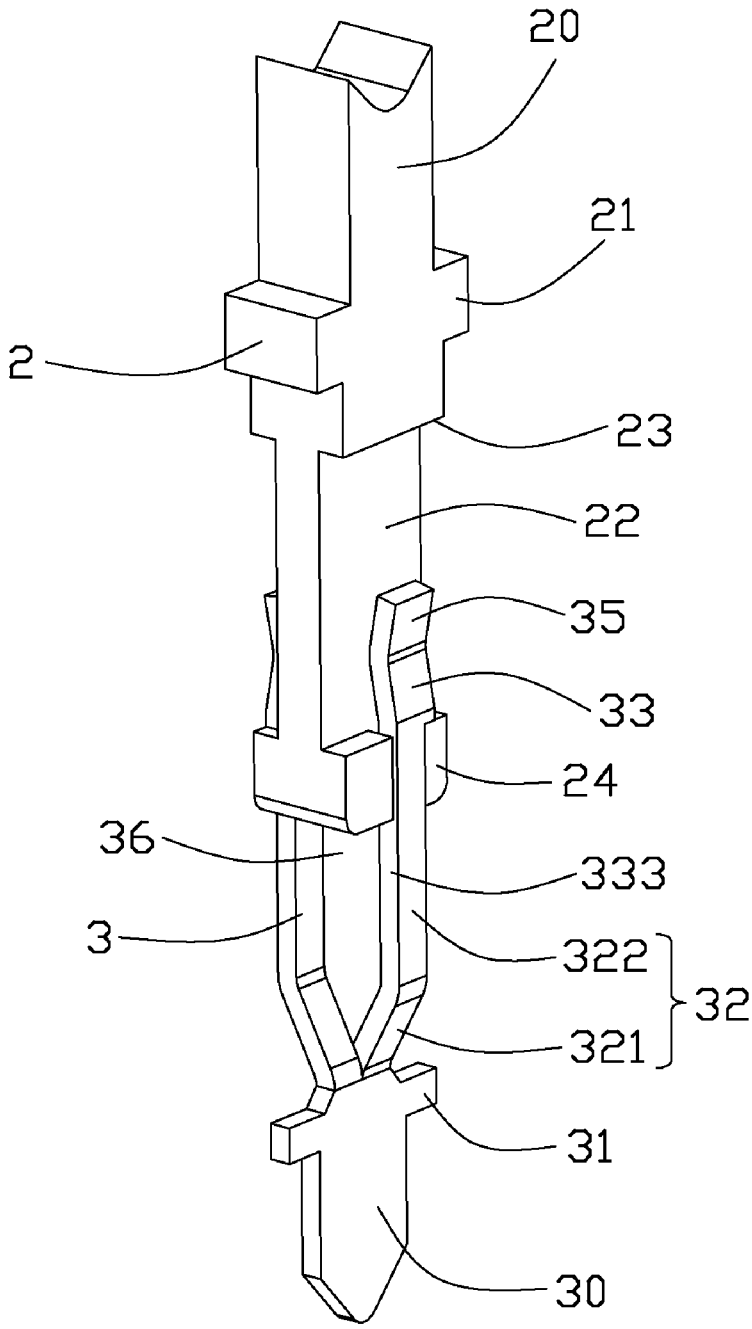
FIG. 3 is a perspective view of upper and lower contact pins of the contact terminal matching with each other and being located in an initial state shown in FIG. 1.
Figure 4:
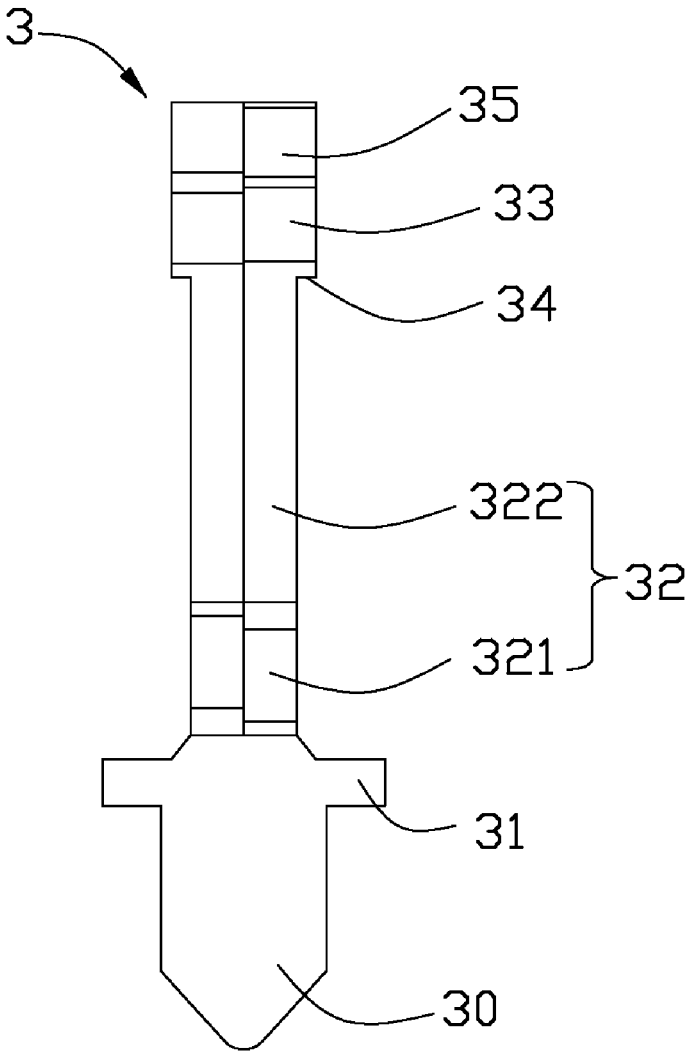
FIG. 4 is a front elevation view of the lower contact pin of the contact terminal shown in FIG. 3.
Figure 5:
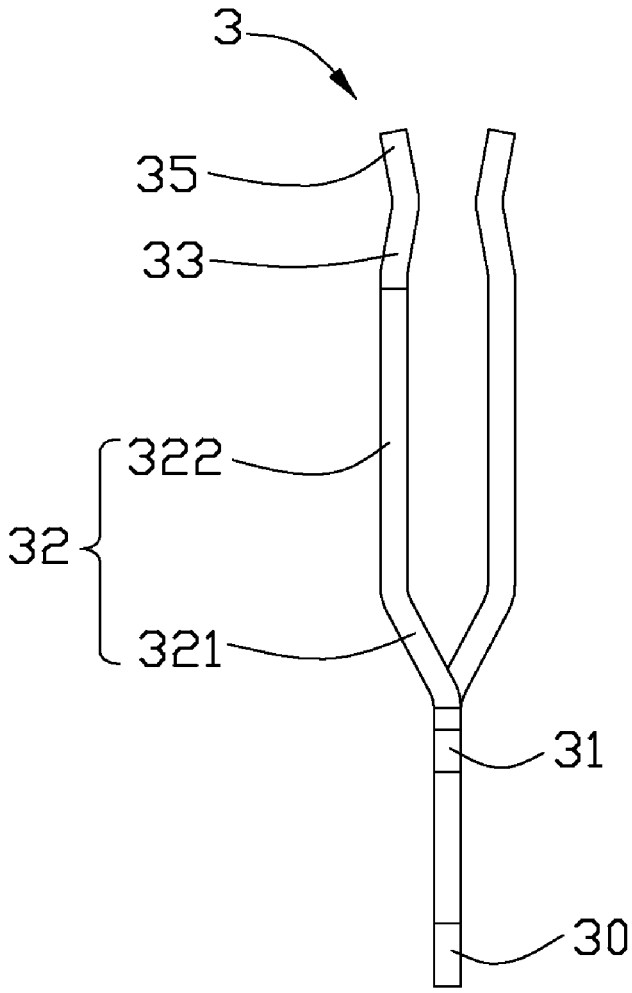
FIG. 5 is a left side elevation view of the lower contact pin of the contact terminal shown in FIG. 3.

Referring to FIGS. 2 and 3, the upper contact pin 2 has a first contacting portion 20 being of a V-type configuration for connecting with the IC (not shown). A pair of first shoulders 21 project from two sides of the first contacting portion 20 and are perpendicular to the first contacting portion 20. A plate-like main portion 22 extends downwardly from a bottom of the first contacting portion 20 and is perpendicular to the first shoulders 21. The first shoulders 21, the first contacting portion 20 and the main portion 22 are located in a same plane. The main portion 22 has a thickness smaller than that of the first contacting portion 20, and a step 23 is formed at a jointing portion of the contacting portion 20 and the main portion 22. Two pair of stopping portions 24 respectively project from one side of the main portion 22 and each has an arch guiding surface 241. The upper contact pin 2 also comprises two guiding slots 25 each formed between two stopping portions 24 located at a same side of the main portion 22. The stopping portions 24 are perpendicular to the main portion 22.

The lower contact pin 3 has a second contacting portion 30 being of a sword-shaped configuration for connecting with the PCB (not shown). The first and second contacting portions 20, 30 are parallel to each other and located in a same plane when the upper and lower contact pins 2, 3 are assembled together. A pair of second shoulders 31 extend outwardly from top sides of the second contacting portion 30 and are perpendicular to the second contacting portion 30. The second contacting portion 30 and the second shoulders 31 are also set in a same plane and comprised in a main body being parallel to the main portion 22 of the upper contact pin 2. A pair of elastic arms 32 respectively received in the guiding slots 25 of the upper contact pin 2 extend upwardly and obliquely from a top of the second contacting portion 30 and can move upwardly and downwardly along the main portion 22. The elastic arms 32 are opposite to each other and located at two sides of the second contacting portion 30. The elastic arms 32 are offset from a central plane of the main body and define a receiving space 36 therebetween for receiving the main portion 22 of the upper contact pin 2.

Referring to FIGS. 2-5, each elastic arm 32 has a clamping portion 33 at a free end thereof The clamping portions 33 can clamp two sides of the main portion 22 of the upper contact pin 2 to ensure good contacting between the upper contact pin 2 and the lower contact pin 3. The clamping portions 33 have a width bigger than that of the elastic arms 32, and two hooks 34 are formed at jointing portions of the elastic arms 32 and the clamping portions 33. The hooks 34 located on an outside of the jointing portions can buckle to the stopping portions 24 of the upper contact pin 2 to prevent the lower contact pin 3 separating from the upper contact pin 2 during a process of moving up and down. The clamping portions 33 each has a palm portion 35 outspreading upwardly therefrom. The palms portions 35 can abut against the steps 23 of the upper contact pin 2 to prevent the lower contact pin 3 from clamping caused by excessive slide of the lower contact pin 3.

Two elastic arms 32 are directly made from lacerating and bending a metallic plate to make the clamping portions 33 be opposite to each other and clamp the main portion 22 of the upper contact pin 2, so that contacting surfaces between the clamping portions 33 and the main portion 22 are smooth surfaces of the metallic plate used to manufacture the electrical connector contact 1. Each elastic arm 32 has a smooth lacerate surface 323 located at an inside thereof The electrical connector contact 1 establishes a reliable contacting of the first and the lower contact pins 2, 3 through the lacerate surfaces 323 of the elastic arms 32 contacting with inner surfaces of the guiding slot 25 and the smooth contacting surfaces between the clamping portions 33 and the main portion 22. The first arm portions 321 are bifurcate from each other and the second arm portions 322 are parallel to each other.

Each elastic arm 32 includes a first arm portion 321 extending upwardly and obliquely from the second contacting portion 30 and a second arm portion 322 extending upwardly and vertically from the first arm portion 321. Each second arm portion 322 has a same width with the guiding slot 25 of the upper contact pin 2. The first arm portions 321 extend from the second contacting portion 30 along opposite directions to make two elastic arms 32 located at two sides of the second contacting portion 30.

The spring device 4 is typically a spring and extends exteriorly around the main portion 22 of the upper contact pin 2 and the elastic arms 32 of the lower contact pin 3. A top end and a bottom end of the spring device 4 can respectively abut against the first shoulders 21 of the upper contact pin 2 and the second shoulders 31 of the lower contact pin 3 to position the spring device 4 between the upper and lower contact pins 2, 3. The spring device 4 can be compressed and moves upwardly and downwardly to drive the upper and lower contact pins 2, 3 moving relative to each other.

When assembling, the spring device 4 is firstly fitted over the main portion 22 of the upper contact pin 2, and then compressed such that making the elastic arms 32 of the lower contact pin 3 received in the guiding slots 25 of the upper contact pin 2. At this time, the clamping portions 33 of the lower contact pin 3 clamp the main portion 22 of the upper contact pin 2. Then, releasing the spring device 4 to force the elastic arms 32 of the lower contact pin 3 moving downwardly along the guiding slots 25 until the hooks 34 of the lower contact pin 3 abut against the stopping portions 24 of the upper contact pin 2. So, the assembly of the contact terminal 1 is completed and the contact terminal 1 is in the initial state (referring to FIG. 3).

The contact terminal 1 of the present invention has some advantages as follow. The elastic arms 32 of the lower contact pin 3 are made from directly lacerating and bending a metallic plate to make contacting surfaces between the main portion 22 of the upper contact pin 2 and the clamping portions 33 of the lower contact pin 3 smooth, so as to achieve a reliable contacting between the upper and lower contact pins 2, 3.

In addition, the contact terminal 1 can prevent the first and the lower contact pins 2, 3 from spacing from each other during moving upwardly and downwardly through the hooks 34 of the lower contact pin 3 abutting against the stopping portions 24 of the upper contact pin 2, so as to reinforce a reliable contacting of the contact terminal 1. Furthermore, the lower contact pin 3 can be prevented from excessive sliding through the palm portions 35 of the lower contact pin 3 abutting against the steps 23 of the upper contact pin 2.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. A contact terminal assembled in a test socket for connecting an integrated circuit (IC) and a printed circuit board (PCB) comprising:

a lower contact pin configured from a sheet metal and including a main body with a pair of elastic arms extending upwardly and offset from a central plane of the main body so as to define a receiving space therebetween;

an upper contact pin configured to electrically couple with the lower contact pin and electrically received within the receiving space defined between the elastic arms contacting with the upper contact pin; and a spring device surrounding both the lower and upper contact pins and biasing the upper and lower contact pins from each other;

wherein the upper contact pin includes a plate-like main portion received in the receiving space of the lower contact pin, and two pair of stopping portions respectively projecting from two sides of the main portion, and two guiding slots each formed between two stopping portions located at a same side of the main portion, and wherein the elastic arms received in the corresponding guiding slots include a pair of clamping portions located at free end thereof and clamping the main portion of the upper contact pin;

wherein the clamping portions each has a width bigger than that of the corresponding elastic arm so as to define two hooks formed at jointing portions of the elastic arms and the corresponding clamping portions, and wherein the hooks abut against the stopping portions of the upper contact pin to prevent the upper and lower contact pins from separating from each other;

wherein the upper contact pin has a first contacting portion for connecting with the IC, wherein the main portion has a thickness smaller than that of the first contacting portion, and wherein a step is formed at a jointing portion of the first contacting portion and the main portion.

2. The contact terminal as claimed in claim 1, wherein the lower contact pin has a second contacting portion for connecting with the PCB, and wherein the first and second contacting portions are parallel to each other and located in a same plane when the first and lower contact pins are assembled together.

3. The contact terminal as claimed in claim 2, wherein the lower contact pin has a pair of palm portions each outspreading upwardly from the clamping portion, and wherein the palm portions can abut against the step of the upper contact pin to prevent the lower contact pin from excessive sliding.

4. The contact terminal as claimed in claim 1, wherein the elastic arms are located in different planes with the second contacting portion and each includes a first arm portion extending upwardly and obliquely from the second contacting portion along opposite directions and a second arm portion extending from the first arm portion.

5. The contact terminal as claimed in claim 4, wherein the first arm portions are opposite to each other, and wherein the second arm portions received in the corresponding guiding slots have a width same with that of the guiding slots of the upper contact pin and are parallel to each other.

6. The contact terminal as claimed in claim 2, wherein the upper contact pin has a pair of first shoulders each projecting from one side of the main portion, and wherein the main body includes a pair of second shoulders extending outwardly from two main body, and wherein the spring device is set between the first shoulders of the upper contact pin and the second shoulders of the lower contact pin.

7. A contact terminal for connecting an integrated circuit (IC) and a printed circuit board (PCB) comprising:

an upper contact pin having a plate-like main portion and two pair of stopping portions respectively projecting from one side of the main portion;

a lower contact pin bifurcately contacting with two opposite surfaces of the main portion of the upper contact pin along a thickness direction of the main portion and having a main body being parallel to the main portion of the upper contact pin and two hooks each located at a bifurcate end of the main body and abutting against the stopping portions to prevent the first and lower contact pins separating from each other; and a spring device disposed between the upper and lower contact pins;

wherein the lower contact pin has a pair of bifurcate elastic arms for contacting with two opposite surfaces of the main portion and bifurcating upwardly and obliquely from the main body, and wherein the elastic arms and the main body are located in different planes, and wherein the hooks are formed at outsides of the elastic arms;

wherein the upper contact pin has two guiding slots each formed between two stopping portions located at a same side of the main portion, and wherein the elastic arms received in the corresponding guiding slots move upwardly and downwardly along the guiding slots;

wherein the lower contact pin has a pair of clamping portions located at free ends of the elastic arms and clamping the main portion of the upper contact pin, and wherein the clamping portions each has a width bigger than that of the corresponding elastic arm, and wherein the hooks each is formed at a jointing portion of the corresponding elastic arm and the clamping portion.

8. The contact terminal as claimed in claim 7, wherein each elastic arm includes a first arm portion and a second arm portion extending upwardly from the first arm portion, and wherein the first arm portions are bifurcate from each other and the second arm portions are parallel to each other.

9. The contact terminal as claimed in claim 8, wherein the upper contact pin has a first contacting portion for connecting with the IC and located in a same plane of the main portion, and wherein the main body of the lower contact pin includes a second contacting portion for connecting with the PCB, and wherein the first arm portions extend upwardly and obliquely from the second contacting portion and are located at two opposite sides of the second contacting portion.

10. The contact terminal as claimed in claim 9, wherein the main portion of the upper contact pin extends downwardly from the first contacting portion and has a thickness smaller than that of the first contacting portion, and a step is formed at a jointing portion of the main portion and the first contacting portion and matches with the elastic arms to prevent the lower contact pin from excessive sliding.

11. A contact terminal comprising:

a first contact pin defining opposite seating surfaces each with a guiding groove therein, and a first outer contacting section with a first shoulder structure extended outwardly from said first outer contacting section;

a second contact pin defining two opposite arm portions which are split from a same plane while deformed by two sides of said plane and moveably seated upon the corresponding seating surfaces, respectively, and a second outer contacting sections with a second shoulder structure extended outwardly from said second outer contacting section; and a coil spring surrounding both said first contact pin and said second contact pin and located between the first shoulder structure and the second shoulder structure;

wherein the arm portions are received in and moved along the corresponding guiding groove when the first contact pin and the second contact pin are moved relative to each other in a longitudinal direction along which both said first contact pin and said second contact pin extend;

wherein a stopper is formed adjacent to one side of each guiding groove and a step structure is formed proximate a free end of each corresponding arm portion for adapted to be engagement with the stopper if the spring urges said first contact pin and said second contact pin away from each other with a maximum distance; and wherein said first contact pin defines different thicknesses thereof in a thickness direction perpendicular to said longitudinal direction, while said second contact pin defines a constant thickness in said thickness direction.

12. The contact terminal as claimed in claim 11, wherein the free end of each arm portion is widened compared with other portions thereof.

13. The contact terminal as claimed in claim 11, wherein said two opposite arm portions are offset from each other in a transverse direction perpendicular to both said longitudinal direction and said thickness direction.

* * * * *